United States Patent [19]

Fraser, Jr.

[11] Patent Number: 5,042,150

[45] Date of Patent: Aug. 27, 1991

[54] METHOD OF ASSEMBLING A SCROLL COMPRESSOR

[75] Inventor: Howard H. Fraser, Jr., Lafayette, N.Y.

[73] Assignee: Carrier Corporation, Syracuse, N.Y.

[21] Appl. No.: 445,780

[22] Filed: Dec. 4, 1989

[51] Int. Cl.[5] ..... B23P 15/00

[52] U.S. Cl. ..... 29/888.022; 29/464; 418/55.1

[58] Field of Search ..... 29/888.022, 434, 464, 29/467, 468, 888.02; 417/366, 369, 310; 418/55

[56] References Cited

U.S. PATENT DOCUMENTS

| | | | |
|---|---|---|---|
| 4,552,517 | 11/1985 | Shimizu | 29/888.022 |
| 4,564,339 | 1/1986 | Nakamura et al. | 417/366 |
| 4,655,696 | 4/1987 | Utter | 29/888.022 |
| 4,730,375 | 3/1988 | Nakamura et al. | 29/888.02 |
| 4,753,582 | 6/1988 | Morishita et al. | 418/55 |
| 4,811,471 | 3/1989 | Etemad et al. | 29/888.02 |

*Primary Examiner*—Irene Cuda

[57] ABSTRACT

A scroll compressor includes an electric motor formed of a stator and a rotor, the rotor having a shaft which is supported by upper and lower bearings. To ensure precise alignment of the upper bearing, lower bearing, and stator within the tubular shell, the lower bearing is a two-piece assembly comprising an outer ring portion and an inner bearing plate. The upper bearing, the stator, and lower bearing outer fing portion are inserted into the tubular shell. An alignment arbor, in the form of a spindle carrying the lower bearing outer ring portion, is inserted into the stator. The upper bearing is installed in the shell onto the arbor. The alignment arbor is expanded against the stator, the upper bearing and the lower bearing outer ring portion to ensure precise alignment. Then the upper bearing, crankcase and lower bearing outer ring portion are affixed, e.g. welded to the tubular shell. The arbor is collapsed and withdrawn. Then the rotor is inserted, and the inner bearing plate of the lower bearing is installed to journal the lower end of the rotor shaft. This compressor assembly significantly simplifies the assembly process while achieving precise alignment. This yields improved reliability, startability, and efficiency.

5 Claims, 2 Drawing Sheets

METHOD OF ASSEMBLING A SCROLL COMPRESSOR

BACKGROUND OF THE INVENTION

This invention relates to rotating machines, e.g. rotary compressors, and is more especially directed to scroll compressors for refrigeration and air conditioning systems, and in which an electric motor is formed of a rotor and a stator in a tubular shell, with the rotor being arranged to drive a scroll compression mechanism. The invention is also directed to the construction of a compressor of this type which facilitates precise alignment of the bearings and stator, so that the rotor assembly can be easily installed in precise alignment with respect to the stator and with respect to upper and lower bearings in which the crankshaft is journalled.

Scroll type rotary machines are used to compress or to pump a gas, and these devices typically have two scroll members each formed of a generally circular end plate and a spiral or involute wrap. The scroll members maintain a fixed azimuth relative to one another but are radially offset so that one orbits about the other. Both wraps interfit to maintain contact at surfaces of the other element, such as to define crescent shaped volumes that move towards the center of the pair of scrolls and become smaller as one scroll member orbits the other.

Relative orbital motion is typically obtained by holding one scroll member fixed in the shell, and orbiting the other by rotating an eccentric crankshaft and holding the orbiting scroll member with an anti-rotation device, e.g., an Oldham ring.

The driven orbiting scroll member, being offset from the axis of the crankshaft, represents an unbalanced torsional load. Even though this is compensated by an eccentric counterweight, there are couple forces acting on the crankshaft when the compressor is at operating speeds.

The drive motor for the compressor has an annular stator armature that is positioned in the compressor's tubular shell, and a generally cylindrical rotor that fits into a cylindrical passage in the stator. To obtain top operating efficiency, the air gap between the rotor and the wall of the passage in the stator should be assymmetrical as possible. The rotor must be held strictly in alignment with the stator for this air gap to be adequately aligned. Also, the crankshaft must be rather precisely supported by the bearing system so that the crankshaft and its associated eccentric drive move the orbiting scroll member in a precise orbiting motion relative to the fixed scroll member. Additionally, to reduce couple forces on the crankshaft, the bearing that supports the upper end of the crankshaft should not extend to far down the crankshaft, so that the rotor counterweight can be positioned as high on the crankshaft as possible.

However, supporting both the upper and lower ends of the crankshaft in bearings means that one of these bearings cannot be installed in the shell until after the rotor assembly is installed. Consequently, this means that it is difficult or impossible to obtain precise alignment of the rotor assembly relative to the stator and upper bearing, because it is difficult or impossible to align the lower bearing precisely with respect to the stator and the upper bearing.

OBJECTS AND SUMMARY OF THE INVENTION

It is an object of this invention to provide a rotary machine and method of assembly therefor which overcomes the drawbacks of the prior art.

It is another object of this invention to provide a rotary machine assembly whose structure facilitates installation of the rotor assembly into the stator and bearings in precise alignment.

It is a still further object of this invention to provide an improved, precisely aligned lower bearing to support a lower end of the crankshaft of the rotor assembly of a scroll compressor or similar rotating machine.

In accordance with an aspect of this invention, a scroll compressor has a tubular shell which contains an armature stator, the stator having a cylindrical axial passage through it of a predetermined radius. A rotor assembly has a crankshaft that is rotatably journalled above and below the stator in an upper bearing and a lower bearing, respectively. The lower bearing is affixed, e.g., by welding a bearing support, to the interior wall of the tubular shell and the upper bearing is affixed to the crankcase. A cylindrical rotor is affixed concentrically on the shaft, fitting within the passage in the stator. A scroll compressor mechanism, comprising a fixed scroll, an orbiting scroll, and an anti-rotating device for the orbiting scroll, is situated above the upper bearing which is supported by the crankcase and is driven by the crankshaft for compressing or pumping the gas or other fluid. Upper and lower end caps close off the upper and lower ends of the tubular shell. The upper end of the crankshaft carries a generally cylindrical journal or crankmember that is received in an upper bearing in the crankcase. The lower bearing is a two-piece assembly, with an outer ring portion that is attached to the wall of the shell, and an inner bearing plate that journals the lower end of the crankshaft. The outer portion has a central opening that is as large as or larger than the passage in the stator, so that the rotor assembly can be installed from below through the outer ring portion. The bearing plate then is fastened, e.g. with bolts, in precise alignment with respect to the upper bearing and stator.

Construction of the compressor assembly according to this invention involves placing the stator into the shell in a shrink fit. Then the upper bearing, crankcase, and lower bearing outer ring portion are placed within the tubular shell and are precisely aligned within the shell using an alignment arbor. The arbor can be in the form of a spindle having expandable cylindrical portions or zones that position the upper bearing, crankcase, and lower bearing outer ring portion within the tubular shell. While held by the alignment arbor, these elements are welded or otherwise affixed in the housing, and then the alignment arbor is withdrawn. The rotor assembly is installed from below through the opening in the lower bearing outer ring portion. Then the bearing is installed onto the outer ring portion to journal the lower end of the rotor assembly crankshaft. This maintains the rotor in precise alignment with the stator, so that the air gap between the rotor and stator can be as symmetric as possible. The remaining elements can be installed in the shell, and then the shell is closed off with the upper and lower end caps.

The above and many other objects, features, and advantages of this invention will be more fully understood from the ensuing description of a preferred embodiment, which is to be read in connection with the accompanying Drawing.

DETAILED DESCRIPTION OF THE PREFERRED EMBODIMENT

Figure 1:
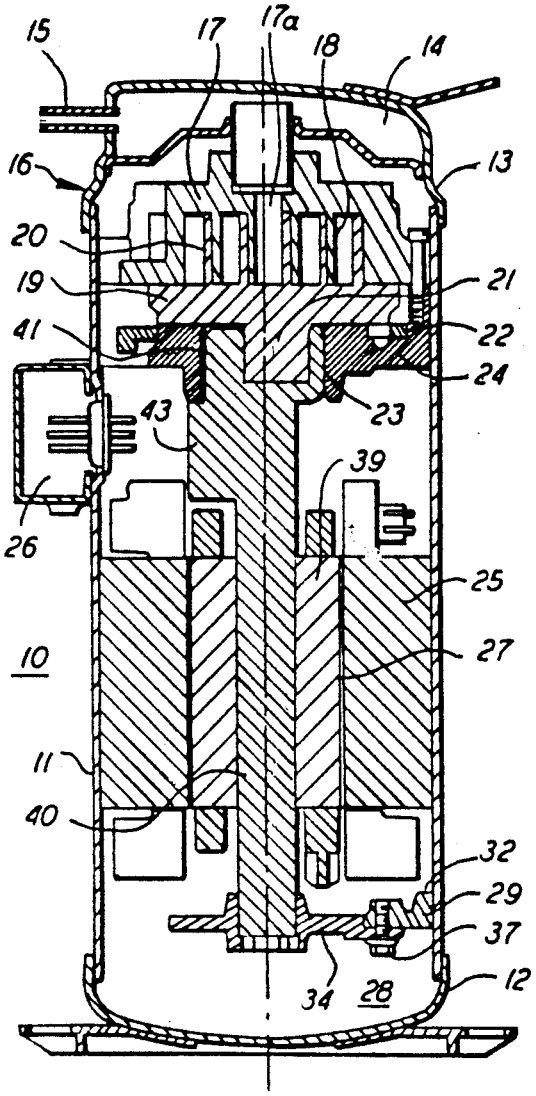
FIG. 1 is a sectional elevation of a scroll compressor constructed according to one preferred embodiment of this invention.

With reference to the Drawing, FIG. 1 shows a scroll compressor 10 which has a vertically oriented tubular cylindrical shell 11. A base 12 in the form of a bottom cap closes off a lower end of the shell 11, and a top 13 in the form of an upper cap closes off a top end of the shell 11. A high pressure dome 14 is formed in the upper cap 13, and has a high pressure outlet 15 through which compressed gas is conducted from a center outlet of a compressor scroll assembly 16.

The scroll assembly 16, as is well known in the art, includes a fixed scroll 17 that has a spiral involute wrap 18, and a facing orbiting scroll 19 that has an involute wrap 20 that is interleaved with the fixed scroll wrap 18. In this embodiment, a male stub 21 extends downward from the axis of the orbiting scroll 19, and constitutes the driven member which revolves in orbiting fashion around the axis of the fixed scroll 17. An anti-rotation mechanism 22, such as an Oldham's ring or the like, holds the scroll 19 against rotation, maintaining a fixed azimuthal orientation while permitting it to revolve or orbit. As with other scroll compressors, which are described in the literature, low pressure gas enters the interleaved scroll wrap 18 and 20 at the periphery thereof, and then is carried and compressed and discharged from the center of the interleaved scrolls.

An upper bearing 23 is fixedly supported within the shell 11 just below the scroll compressor assembly 16. The bearing 23 is rotationally supported in a generally cylindrical upper journal 24, i.e., a crankcase, coaxial with the center of the fixed scroll.

A stator 25 which constitutes the motor armature for the scroll compressor 10 is also fixedly mounted within the tubular shell 11. An electrical connector 26 which is mounted on the side of the shell 11 provides electric current to the windings on the stator 25. Also, the stator 25 has a central axial passage 27, which is cylindrical and has a predetermined, uniform radius.

Figure 2:
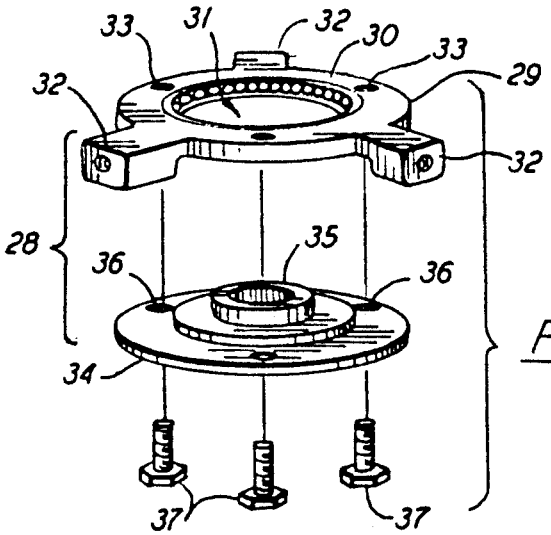
FIG. 2 is an exploded perspective view of a two-part lower bearing for the scroll compressor of FIG. 1.

A lower bearing assembly 28, shown in more detail in FIG. 2, consists of two major parts. An outer ring portion 29, in the form of a spider, has a ring 30, with an opening 31 that has a radius as great as or greater than the radius of the stator passage 27. A number of legs 32 radiate from the ring 31, and provide surfaces which can be welded to the inside surface of the tubular shell 11. A number of bores 33 extend axially through the ring 30 outside the opening 31.

An inner bearing plate 34 has a central journal 35 and a number of axial bores 36 that are in registry with the bores 33 of the outer ring portion 29. The inner bearing plate 34 can be accurately positioned on the outer ring portion 29, and attached thereto with bolts 37 that pass through aligned ones of the bores 33 and 36.

Figure 5:
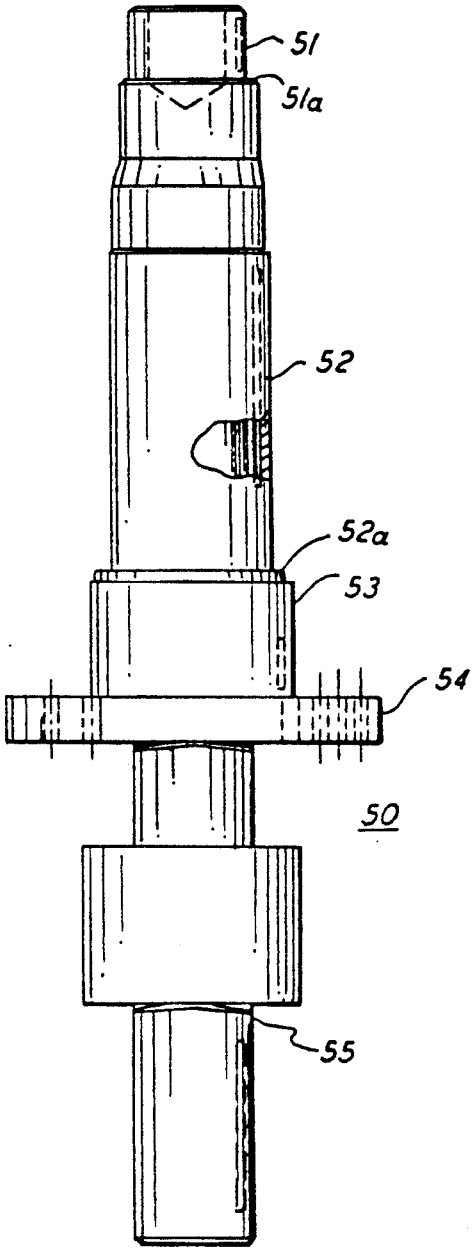
FIG. 5 shows an alignment arbor which can be employed in assembly of the scroll compressor of the preferred embodiments of this invention.
Figure 3:
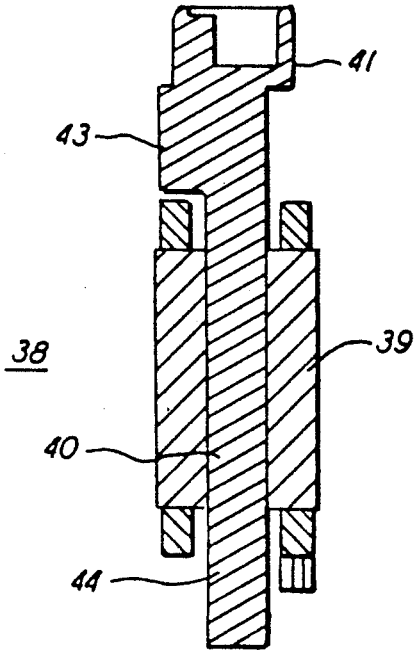

A rotor assembly 38, also shown with reference to FIG. 3, has a generally cylindrical rotor 39 that has a radius that is slightly less than the radius of the stator cylindrical passage 27. The rotor 39 is positioned within the passage 27, with a small annular gap between the rotor and the stator. A crankshaft 40 for the rotor assembly extends axially through the rotor 39 and has a generally cylindrical crank or journal 41 situated at its upper end. The journal 41 has an off-axis receptacle to receive the male stub 21 of the driven orbiting scroll 19. The cylindrical journal 41 is received in the bearing 23 of the housing 24. Immediately below the journal 41 is an eccentric counter weight 43 that is integrally formed as part of the crankshaft 40 and is situated diametrically opposite the offset of the orbiting scroll. In this embodiment, the counterweight 43 is in the form of a portion of a cylinder that has a radius smaller than the predetermined radius of the stator passage 27. That is, the radial extent of the counterweight 43 is small enough to pass through the passage 27 when the stator assembly 38 is installed from below. A lower end 44 of the shaft 40 protrudes from a lower end of rotor 39 and is journalled in the central journal 35 of the inner bearing plate 34. This construction of the compressor assembly permits accurate alignment of the bearing system within the scroll compressor 10, both from a concentricity standpoint, and from a perpendicularity standpoint as well. A preferred alignment step in the construction of this compressor can be briefly explained as follows, with reference to FIGS. 4, and 5.

Figure 4:
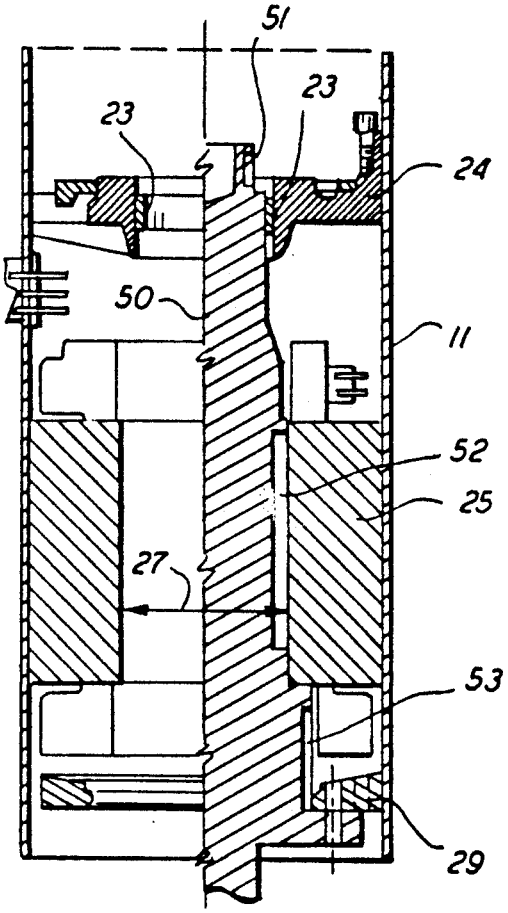
FIGS. 3 and 4 are sectional elevations of rotor assembly and of partly constructed housing with stator, crankshaft, and bearings, respectively, for the scroll compressor of FIG. 1.

An alignment arbor 50, as shown in FIG. 4, is employed to construct the scroll compressor 10. The arbor 50 is an alignment tool generally in the shape of a spindle.

In assembly of the compressor 10, the first step is to fixedly secure the stator 25 within the tubular shell 11 by a shrinking or press fit. This may be suitably done by heating the shell 11 and the placing stator in the heated shell and permitting the shell to cool. The arbor 50 has three selectively pressurizeable zones 51, 52, 53, and associated therewith are shoulders 51*a*, 52*a*, and a flange 54, respectively, for axially locating the parts. The lower bearing ring 29 is placed on the arbor 50 such that the ring 29 rests on the flange 54. Arbor 50 together with the bearing ring 29 is inserted into the shell 11 such that the shoulder 52*a* engages the stator 25. The crankcase 24 which carries the bearing 23 is placed into, the shell 11 and on the arbor 50 such that the bearing 23 engages the shoulder 51*a*. This properly locates the member axially and the expansion zone 51 is within the bearing 23, the zone 52 is within the bore 27, and the zone 53 is within the bearing ring 29. With the arbor 50 properly axially located by the engagement of the shoulder 52*a* with the stator 25, the zone 52 is pressurized. This properly locates the arbor 52 radially and fixedly locates the arbor 50 with respect to the stator 25. The zone 51 is then pressurized which properly radially locates the bearing 23 and the crankcase 24 such that the crankcase 24 can be welded to the shell 11 and the zone 51 can be depressurized. The zone 53 is then pressurized which properly radially locates lower bearing ring 29 which may then be welded to shell 11. The zones 52 and 53 are then depressurized which permits the arbor 50 to be withdrawn for the stator 25 and the shell 11. The zone 52 must be kept pressurized during the foregoing procedure because assembly is keyed off the stator 25 rather than the shell 11. The three zones 51, 52, and 53 have individual radially expandable portions allowing the alignment arbor 50 to be expanded radially to lock the upper bearing, and the lower bearing outer ring portion in predetermined, precisely aligned positions relative to the stator 25. A radial flange 54 ensures the lower bearing outer ring portion 29 is perpendicular to the bearing axis.

A mount 55 on the alignment arbor positions the arbor on an assembly station, workbench, or the like.

With the housing 24 and lower bearing outer ring portion 29 positioned and held in place by the alignment arbor 50, the housing 24 and outer ring portion 29 can be welded or otherwise affixed in place onto the shell 11. Then, the alignment arbor can be withdrawn. At this stage, the rotor assembly can be installed through the opening 31 in the lower bearing outer ring portion 29, so that the journal 41 at the upper end of the shaft 40 is accurately positioned in the bearing 23, and the rotor 39 is accurately positioned within the cylindrical passage 27 in the stator 25. The inner bearing plate 34 is then installed onto the lower bearing outer ring portion 29 so that the journal 35 carries the lower end 44 of the shaft in precise alignment with respect to the housing 24 and stator 25. At that time, the remaining elements such as the scroll compressor assembly 16 can be installed, and the housing closed off with the upper and lower end caps 12 and 13.

In the scroll compressor assembly 10 constructed as described, there is precise alignment maintained between the main bearing 23 and the lower bearing 28, as well as with the stator 25. This permits the air gap between stator 25 and rotor 39 to be accurately symmetric. This ensures long-term reliability, good startability, and optimal efficiency.

If prior art techniques are employed, it is especially difficult to accomplish this precise alignment, as it must be attended to during the compressor final assembly, and cannot simply be done as an off-line subassembly.

Because a two-piece lower bearing 28 is employed, the accurate installation of the rotor assembly 38 can be easily accomplished, and can be automated, if desired.

It should be understood that the terms of orientation, such as "upper", "lower", "above", and "below" are used for simplicity for explaining the Drawing figures. The compressor assembly could be installed in other orientations, still employing the same principles of this invention. Also, other rotary compressor mechanisms could be employed still using the techniques of this invention, for example, a scroll compressor in which both scrolls rotate about parallel axes, or another type of rotary compressor. While the invention has been described with detail with respect to a single preferred embodiment, it should be understood that the invention is not strictly limited to that precise embodiment. Rather, many modifications and variations would present themselves to those with skill in the art without departure from the scope and spirit of this invention, as defined in the appended claims.

What is claimed is:

1. A method of assembly of a scroll compressor of the type in which a tubular shell contains an armature stator which has a cylindrical passage therethrough of a predetermined radius, a rotor assembly has a shaft which is rotatably journalled above and below the stator in an upper bearing and a lower bearing, respectively, which are fixedly disposed within said tubular shell, and a cylindrical rotor is affixed concentrically on said shaft fitting within the passage of said stator, compressor means mounted above said upper bearing and driven by said rotor shaft for compressing a gas, and upper and lower end cap means which close off upper and lower ends of said tubular shell; the method comprising the steps of:

installing and securing said stator within said shell;

installing an outer ring portion of said lower bearing into said shell below said stator, said outer ring portion having a central opening therein that has at least as large a radius as that of the passage of said stator, by placing the outer ring portion onto an alignment arbor and inserting same into the shell, so that the alignment arbor passes through said stator;

placing said upper bearing onto the alignment arbor above said stator;

expanding said alignment arbor radially to lock said upper bearing, said stator, and said lower bearing outer ring portion in predetermined precisely aligned positions within said shell;

affixing said precisely aligned upper bearing and lower bearing outer ring portion onto the interior wall of said shell;

withdrawing said alignment arbor;

installing said rotor assembly through said opening in the lower bearing outer ring portion so that the upper end of the shaft is journalled in said upper bearing and said rotor is positioned within the cylindrical passage of said stator;

installing a central bearing plate member onto said lower bearing outer ring portion to journal the lower end of said shaft in precise alignment with respect to said upper bearing and said stator; and installing said compressor means and said upper and lower end cap means.

2. The compressor assembly method of claim 1 wherein said affixing the upper bearing and the lower bearing outer ring portion to said tubular shell includes welding radially outer portions of a crankcase that carries said upper bearing and radially outer portions of said lower bearing outer ring to said tubular shell.

3. The compressor assembly method of claim 1 wherein said lower bearing outer ring portion has a plurality of bores therethrough radially beyond said central opening, and said bearing plate member has a like plurality of bores therethrough in registry with the first mentioned bores, and said steps of installing said bearing plate member onto said lower bearing outer ring portion includes aligning the bores of the plate member with the bores of the outer ring portion and securing them together with threaded fasteners passing through the aligned bores.

4. The compressor assembly method of claim 1 wherein said alignment arbor is generally in the form of a spindle having an upper expandable, generally cylindrical portion to align said upper bearing, a central expandable, generally cylindrical portion to position against said stator, and a lower expandable generally cylindrical portion to align the lower bearing outer ring portion.

5. The compressor assembly method of claim 4 wherein said alignment arbor further includes a radial flange at a lower edge of said lower expandable portion.

* * * * *